US007625294B1

(12) United States Patent
Isaac et al.

(10) Patent No.: US 7,625,294 B1
(45) Date of Patent: Dec. 1, 2009

(54) GOLF SWING POWER SHIFT BOARD

(76) Inventors: Douglas Paul Isaac, 1219 N. Columbus Ave., No. 305, Glendale, CA (US) 91202; Linda C. Isaac, 1219 N. Columbus Ave., No. 305, Glendale, CA (US) 91202

( * ) Notice: Subject to any disclaimer, the term of this patent is extended or adjusted under 35 U.S.C. 154(b) by 0 days.

(21) Appl. No.: 12/008,034

(22) Filed: Jan. 8, 2008

(51) Int. Cl.
*A63B 69/36* (2006.01)

(52) U.S. Cl. ..... 473/218; 473/269

(58) Field of Classification Search ..... 473/218, 473/261, 269, 270, 272, 278, 279
See application file for complete search history.

(56) References Cited

U.S. PATENT DOCUMENTS 3,352,559 A * 11/1967 Larsen ..... 473/269
4,088,325 A * 5/1978 Sutton ..... 473/269
4,355,810 A * 10/1982 Rydeck ..... 473/218
5,916,036 A * 6/1999 Hamilton ..... 473/269
2004/0014571 A1* 1/2004 Haynes ..... 482/142
2007/0202970 A1* 8/2007 Miller et al. ..... 473/451
2009/0029789 A1* 1/2009 Davies ..... 473/218

* cited by examiner

*Primary Examiner*—Nini Legesse
(74) *Attorney, Agent, or Firm*—Thomas I. Rozsa

(57) ABSTRACT

The present invention is a golf swing power shift board that has various positioning markers within the bottom surface of the board to receive height adjustment risers in various orientations so that different types of golf swings can be practiced in order to improve the golfer's golf swing and balance.

18 Claims, 18 Drawing Sheets

GOLF SWING POWER SHIFT BOARD

BACKGROUND OF THE INVENTION

1. Field of the Invention

The present invention relates to the field of golf and more particularly to an apparatus to assist a golfer in improving a golfer's game by training and exercising and practicing weight transfer and body alignment associated with the different types of golf swings.

2. Description of the Prior Art

During the present inventors' task to achieve a more repeatable "pro-like" golf swing, the inventors researched many articles on the topic of "body balance" and have received very expensive instruction from a golf company called "Body Balance." The "Body Balance" courses were very helpful. However, as recreational golfers, the present inventors could not see continuing the courses at such a high price per lesson. As for the training aides available on the market, the present inventors found themselves very uncomfortable with using them, especially in public. They would not want to bring the Australian-manufactured Dura-disc air pillows (Example 1), the Bosu (Example 2), the Pro-Wobble Rocker (Example 3), or two chairs (Example 4) to the golf range. Those devices are too cumbersome and costly.

SUMMARY OF THE INVENTION

The inventors developed a simple training aide that can be positioned easily to work on different aspects of weight transfer and body alignment associated with the different types of golf swings. In addition, this training aide will develop the body balance required to execute various shots on the course (e.g. uphill lies, ball below the feet, etc.). These various swings need to be consistently repeated to gain a better understanding of the game. The understanding of body movement and weight transfer will lead to lower scores and more enjoyment of the game.

The Golf Swing Power Shift Board (GSPSB) was designed with physical conditioning in mind to achieve a repeatable, balanced, sequential and efficient, yet powerful, golf swing. It can be used year round indoors and outdoors. The GSPSB is similar to physical therapy balance boards that assist patients by strengthening the muscles associated with proper body balance, but it is specifically designed to fit the needs of the golfer. It can be used for golf swing physical training with all standard golf clubs, weighted golf swing training clubs, medicine ball, and other light weight training devices (Examples 5, 6, 7 & 8). It comes in various sizes to meet the height and weight requirements of various golfers of all ages.

Proper use of the GSPSB on a regular basis will assist the golfer with the most difficult move of the golf swing—the transfer of weight towards the target on the downswing. This weight transfer is also called the "power shift" The primary function of the GSPSB is to condition the golfer's mind and body to efficiently store and release the 321 "torque" that is created from a smooth, rhythmic, and sequential weight transfer—the key to a powerful swing. The release of torque naturally occurs at the completion of his/her back swing when the golfer shifts his/her weight to the front foot and pivots around the front leg just prior to the completion. The power shift to the leading leg, then the rotation of the body starting with the left foot, knee, upper leg (especially the hamstrings, buttocks, and abdominal muscles), shoulders, arms, hands and club turning toward the target at the completion of the back swing releases the coil that was produced during the back swing that produced the initial weight shift onto the back leg.

Weight transfer is not only important to a proper and powerful golf swing, but it is used in baseball by batters preparing to swing at a pitch. As the batter lifts the heel and/or entire foot off the ground facing the pitcher, weight is transferred to the back leg. When the batter plants the same foot back down to the ground, his body weight is transferred towards the target and that movement initiates the rest of the swing. Baseball pitchers also use weight transfer to assist with the coil that is needed to produce a 100 mph pitch. A similar motion is made in tennis when an aggressive forehand swing is made. The weight transfers to the leg facing the net and the hips and torso rotate to the target followed by the arms to completely transfer the weight to the front side. The coil is the key component to gain torque.

By utilizing the Foot Positioning Templates (FPT) that accompany the GSPSB, the golfers can also work on the body balance associated with full shots, pitch shots, chipping, draw and fade shots. In addition, the combination of Height Adjustable Risers (HAR) will enable the golfers to practice a variety of golf shots (e.g. uphill and downhill lies, as well as side hill lies when the ball is above and below the feet).

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
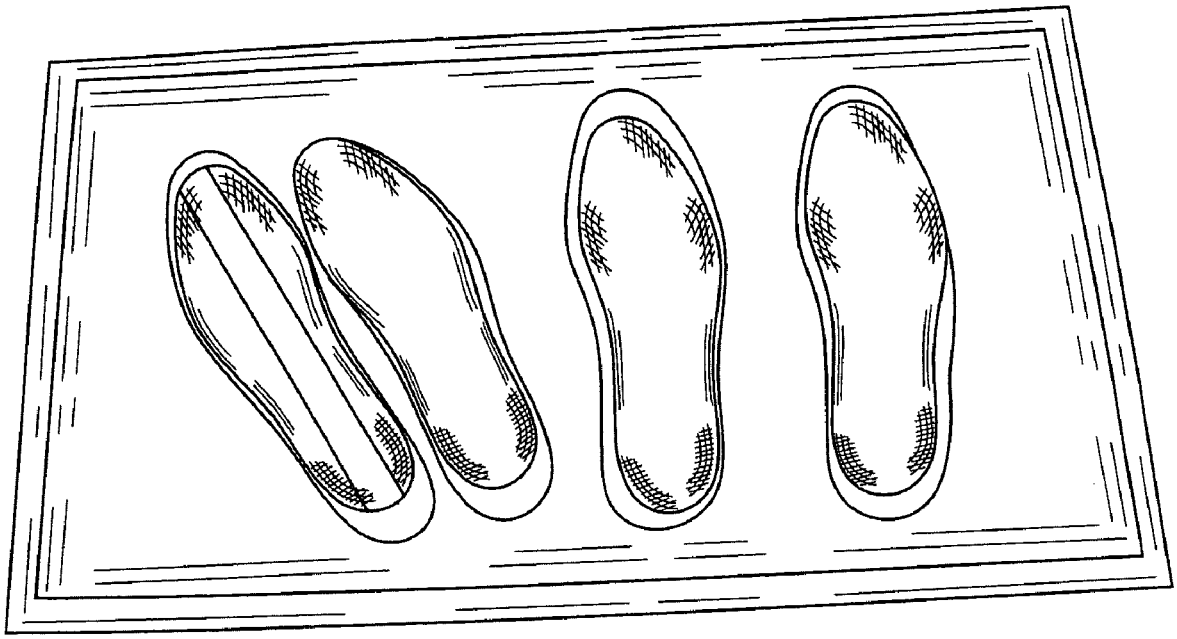
FIG. 1 is a top perspective view of the present invention golf swing power shift board.
Figure 3:
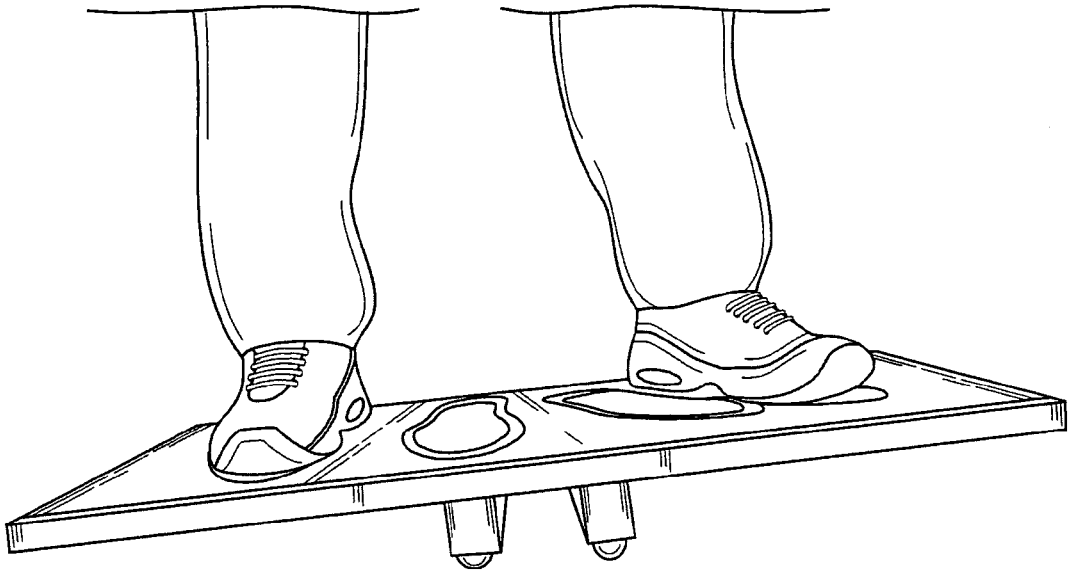
FIG. 3 is a front perspective view of the present invention golf swing power board in use demonstrating a pivoting action.
Figure 4A:
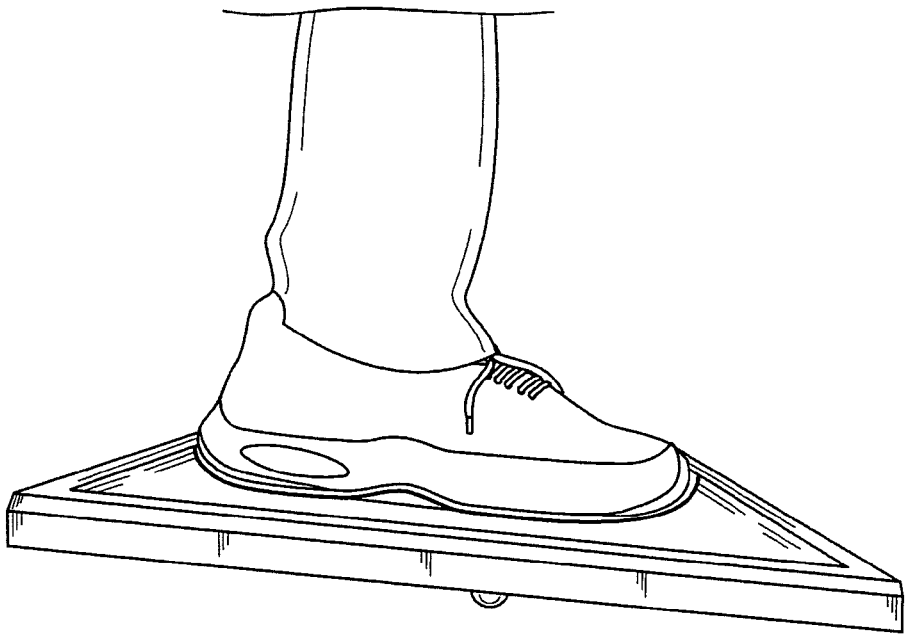
FIG. 4A is a side perspective view of the present invention golf swing power shift board showing a forward pivoting motion.
Figure 4B:
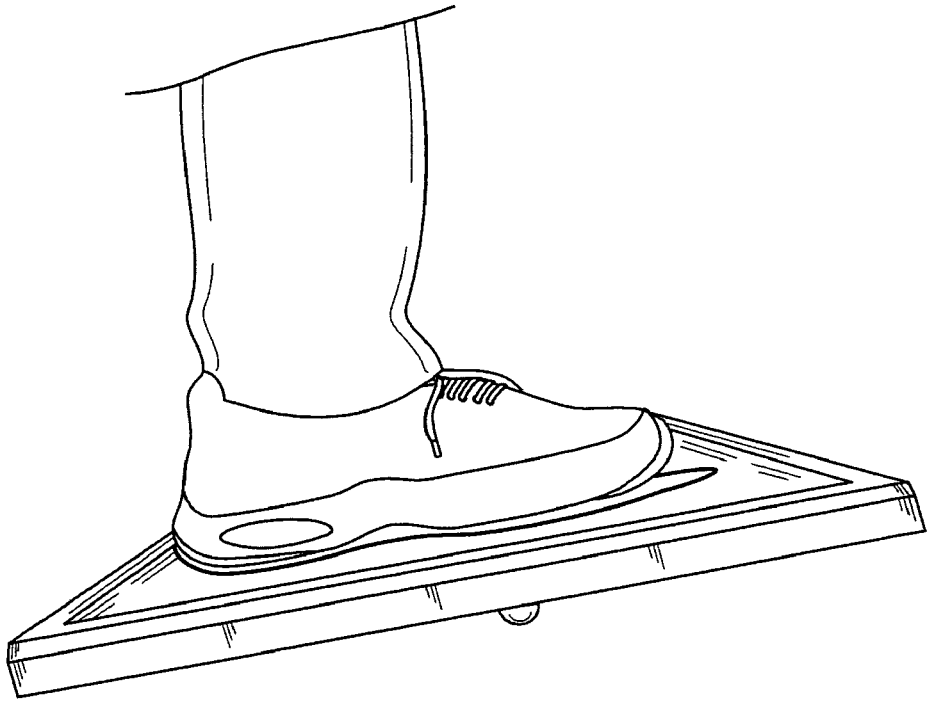
FIG. 4B is a side perspective view of the present invention golf swing power shift board showing a backward pivoting motion.
Figure 5:
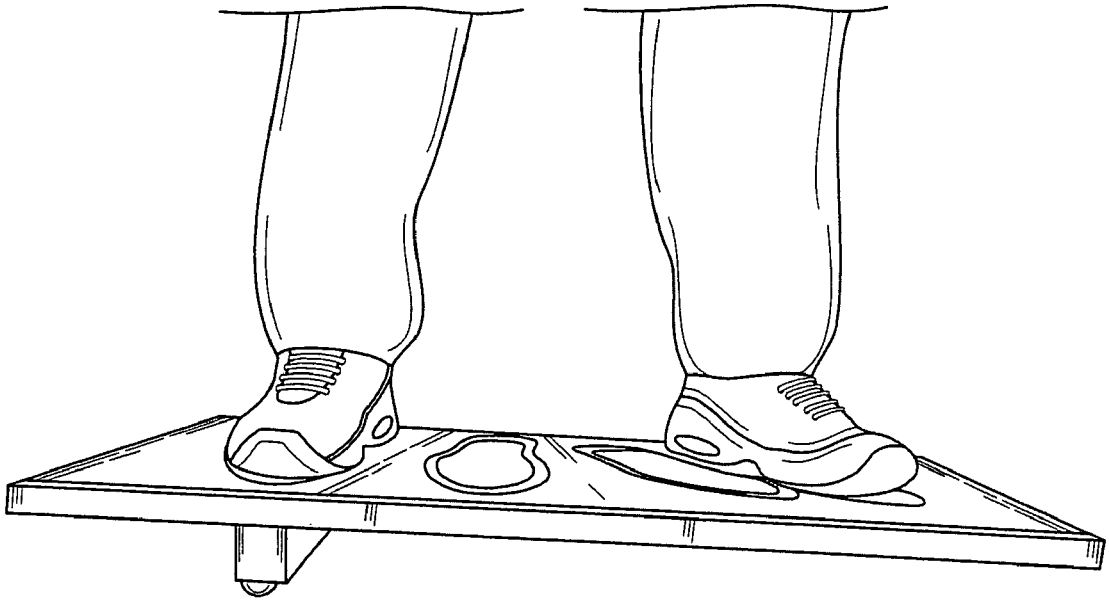
FIG. 5 is a front perspective view of the present invention golf swing power shift board showing a downhill motion.
Figure 6:
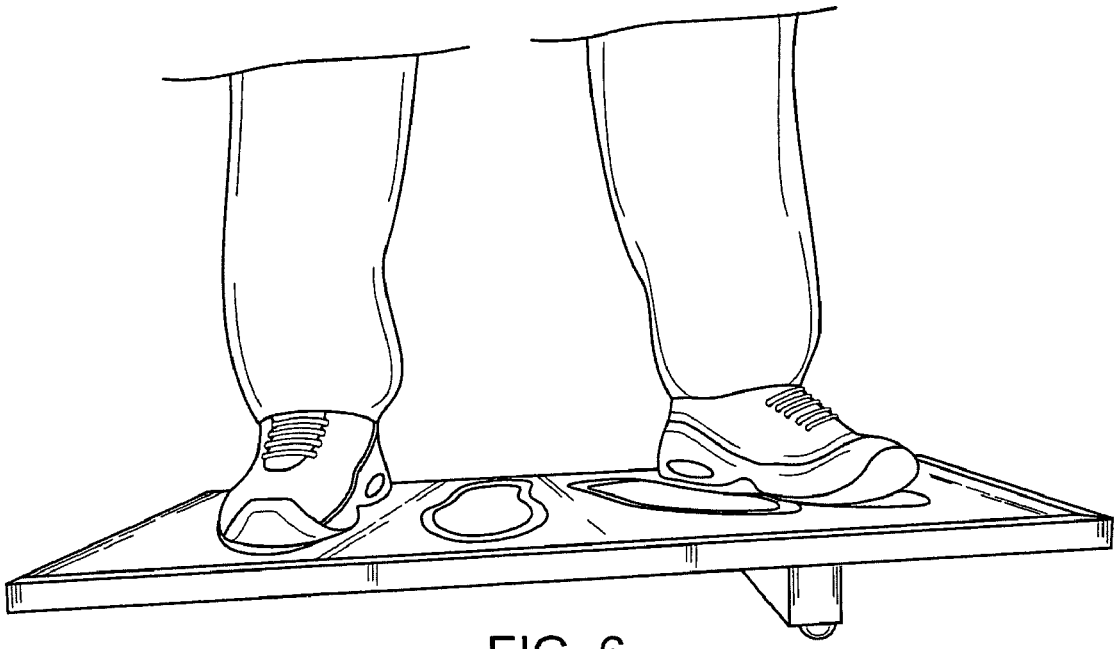
FIG. 6 is a front perspective view of the present invention golf swing power shift board showing an uphill motion.
Figure 7:
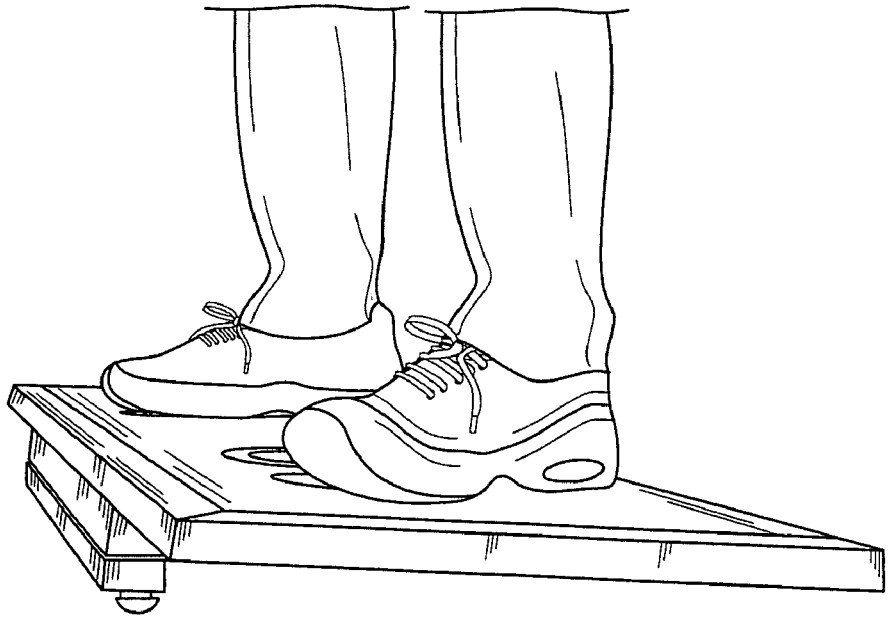
FIG. 7 is a side and front perspective view of the present invention golf swing power shift board showing the apparatus in use while the golfer is swinging at a ball, with the golfer's feet tilted backward so that the ball would be above the golfer's feet.
Figure 8:
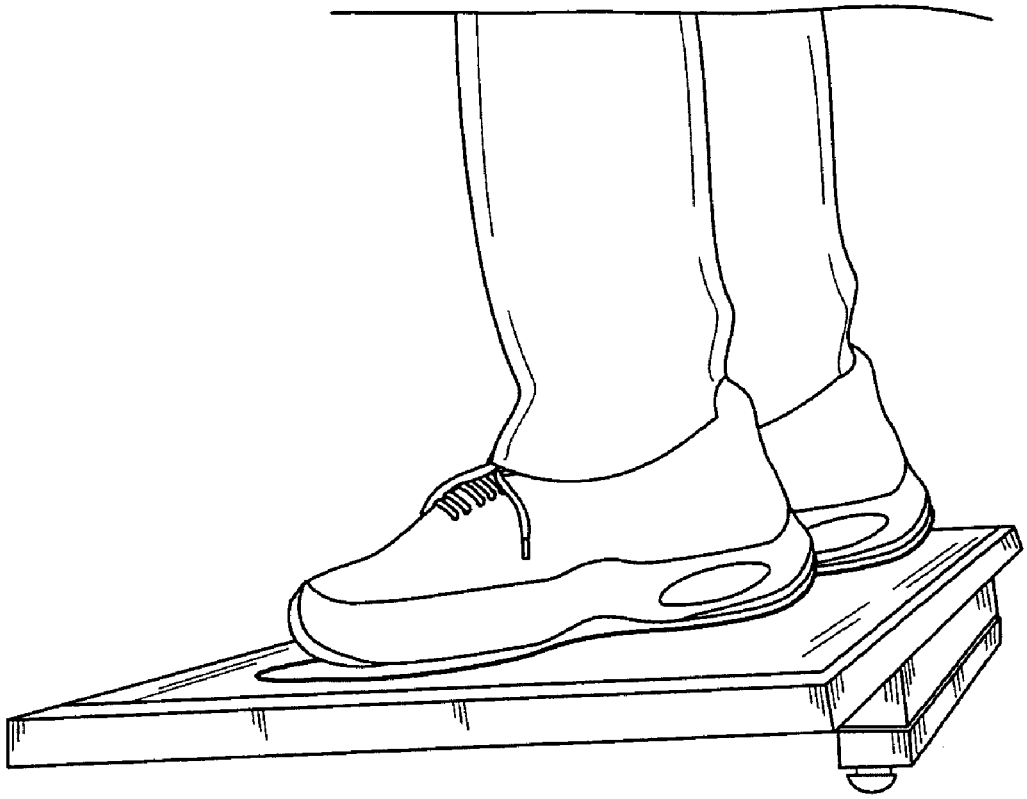
FIG. 8 is a side and rear perspective view of the present invention golf swing power shift board showing the apparatus in use in a downhill motion with the golfer attempting to swing at a ball with the golfer's feet tilted downward so that the ball will be below the golfer's feet.
Figure 9:
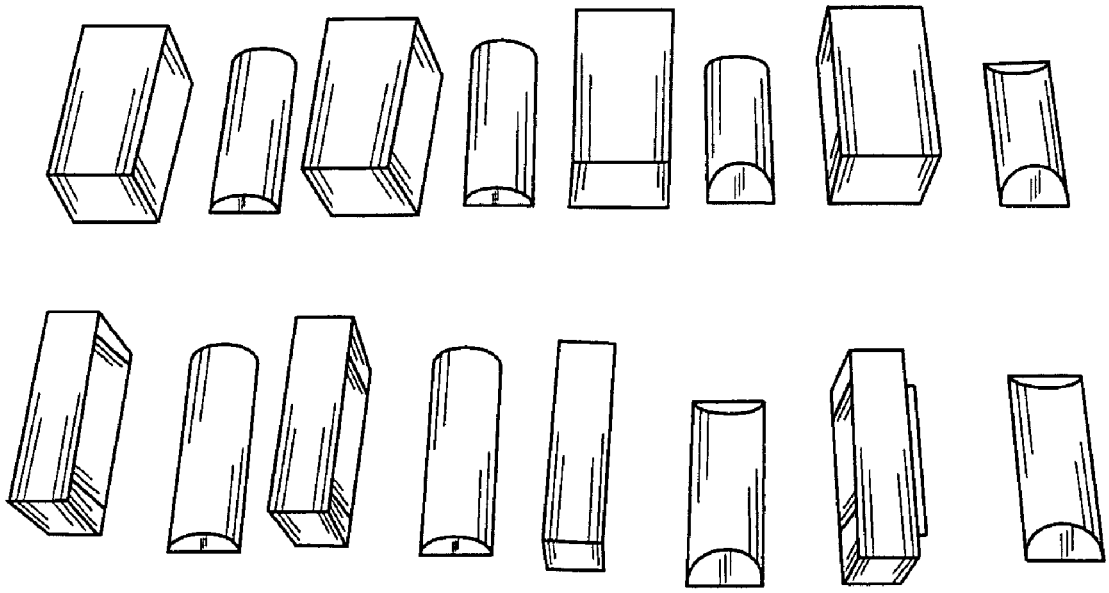
FIG. 9 is a perspective view of 16 additional height adjustable risers that can be attached to a commercially sold golf swing practice mat.
Figure 10:
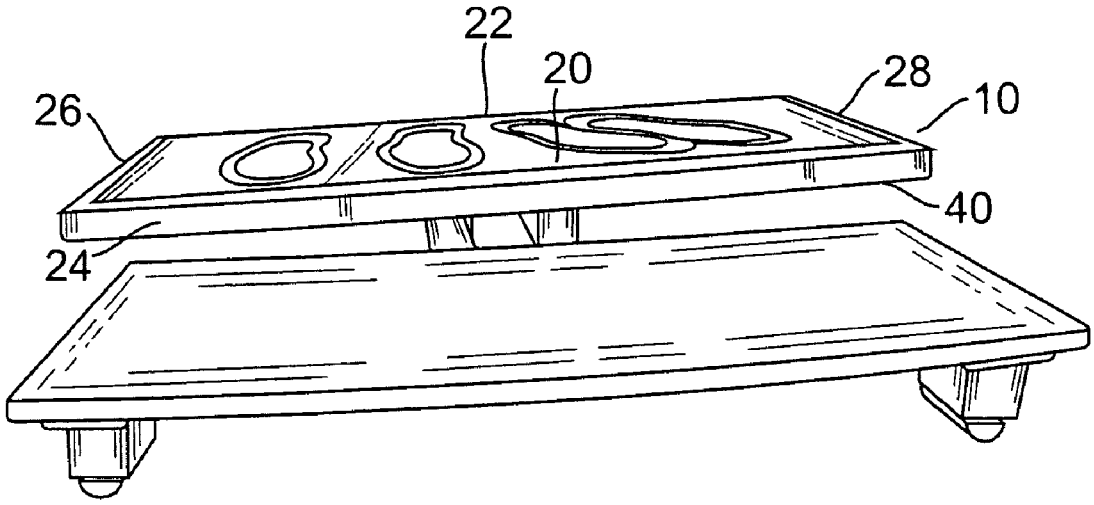
FIG. 10 is a perspective view of the present invention power swing power shift board also used in conjunction with a commercially available golf practice mat.
Figure 11:
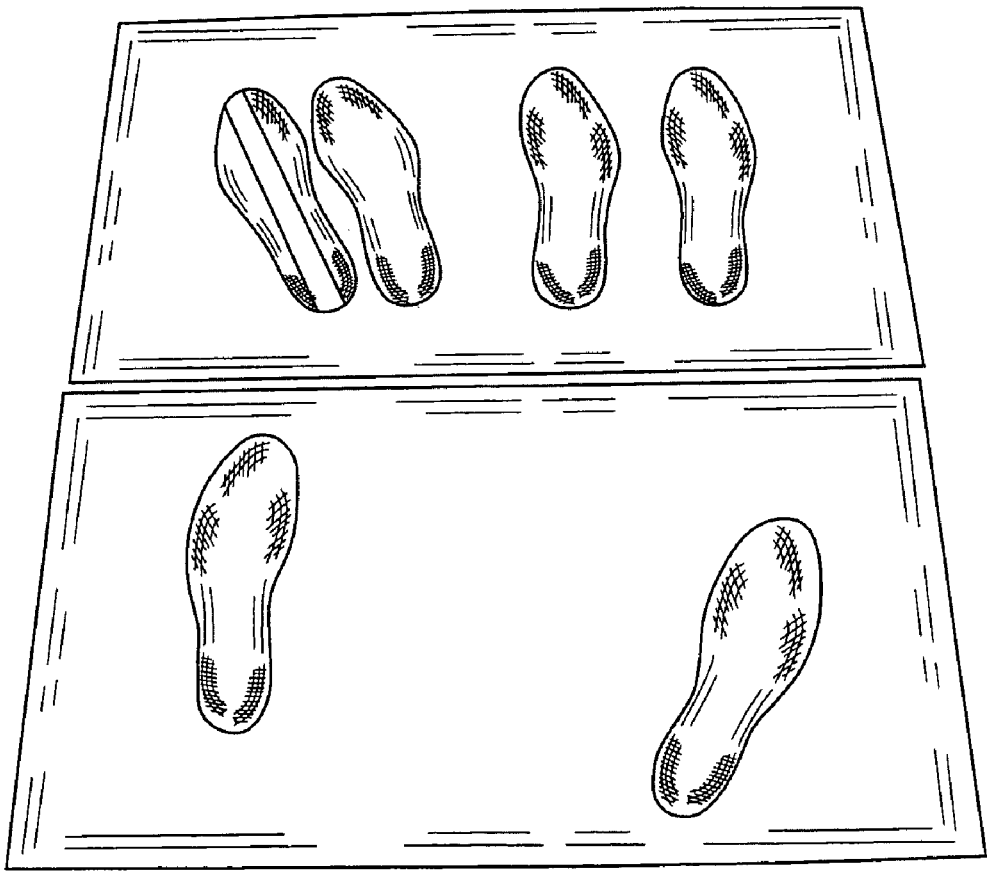
FIG. 11 is a top perspective view of a couple of positioning templates of the present invention.

The Golf Swing Power Shift Board (GSPSB) (FIG. 1) is a rectangle wood (or aluminum or hard plastic—TBD) plank approximately 18"×32"×1" (Example 9). It contains twelve rubber/plastic Height Adjustable Risers (HAR) (FIG. 2 & Example 10) that allow the GSPSB to pivot from right to left (FIG. 3), forward and back (FIG. 4); produce downhill (FIG. 5) and uphill lies (FIG. 6); and produce the feeling of swinging at a ball above (FIG. 7) and below (FIG. 8) the feet. To facilitate golf swings using standard golf clubs, there are an additional sixteen HAR (FIG. 9) that can be attached to commercially sold golf swing practice mats to replicate the ball position in relation to the position of the GSPSB. Attaching these sixteen HAR to a commercially sold golf practice mat will allow the golfer to hit real or practice golf balls while working on the body balance and power shift associated with the various golf swings (FIG. 10). To assist both right- and left-handed golfers, there are two double-sided interchangeable artificial turf or see-through (TBD) Foot Positioning Templates (FPT) (FIG. 11) that insert into or onto (TBD) to the GSPSB outlining the full swing (FIGS. 12A&B), pitch shot (FIGS. 13A&B) and chip shot (FIGS. 14A&B), as well as the Closed Stance (FIG. 15) to draw the ball, and the Open Stance (FIG. 16) to fade the ball. Note: the GSPSB comes with the right-handed FPT pre-positioned in place. To change the FPT, open the four sides of the aluminum frame or lift up magnetic (TBD) FPT, lift out the FPT and turn it over if you are left-handed, or remove it and replace it with the Closed Stance FPT to draw the bail or Open Stance FPT to fade the ball.

Figure 17:
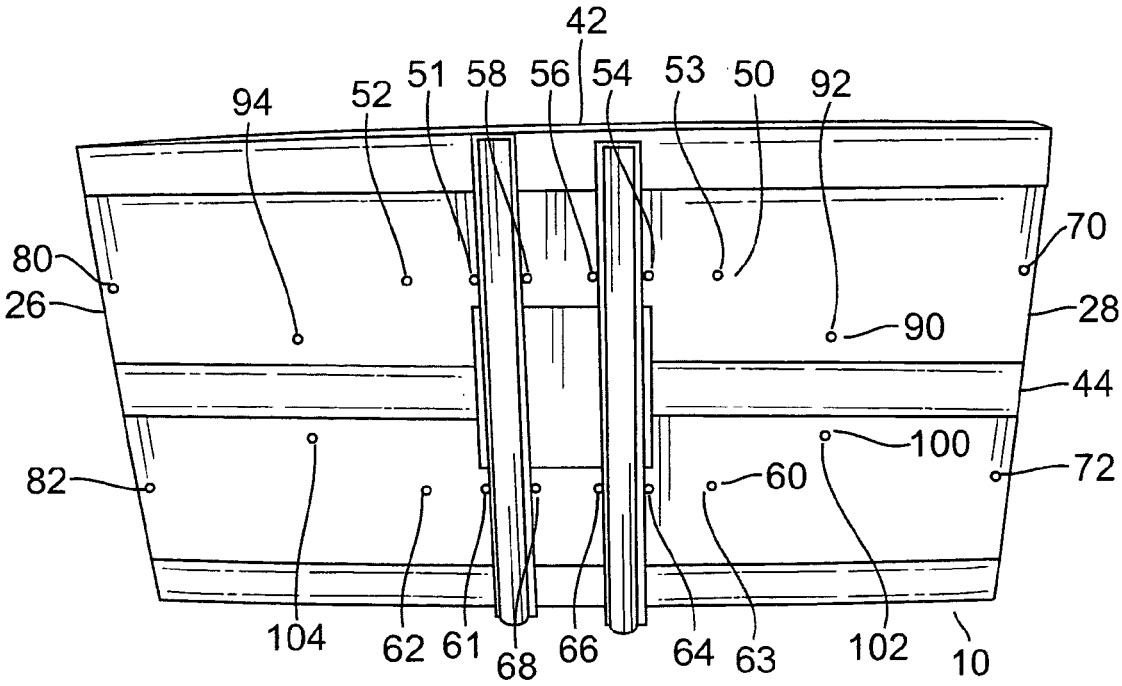
FIG. 17 is a bottom perspective view of the present invention golf swing power shift board with two adjustable risers placed in the red positioning markers.

The GSPSB is an apparatus to improve a golf swing. Referring to FIGS. 9, 10 and 17, the apparatus in the preferred embodiment is a generally rectangular shaped plank 10 having an upper surface 20 and a lower surface 40, a pair of oppositely disposed lengthwise sides 22 and 24 and a pair of oppositely disposed widthwise edges 26 and 28, a longitudinal centerline 42 and a widthwise centerline 44. It is within the spirit and scope of the present invention for the plank to have shapes other than rectangular such as oval and square.

Referring to FIGS. 17, 19, 20 and 21, the lower surface of the generally rectangular shaped plank 10 has a multiplicity of positioning markers including a first and second parallel row of positioning makers 50 and 60 which are referred to as red markers aligned along the lengthwise distance of the generally rectangular shaped plank 10, each positioning marker 52, 54, 56, 58, 51, 53 and 62, 64, 66, 68, 61 and 63 in a row spaced apart from an adjacent positioning marker by a given distance, the two rows of positioning markers respectively spaced away from a respective lengthwise side of the plank and also spaced apart from each other by a given distance D1.

The lower surface also has a first pair of positioning markers 70 and 72 adjacent one widthwise edge 28 of the plank and a second pair a positioning markers 80 and 82 adjacent an opposite widthwise edge 26 of the plank, a respective positioning marker from the first pair aligned with a respective positioning marker from the second pair, (70 aligned with 80 and 72 aligned with 82). These markers are referred to as blue markers. The lower surface also has a third pair of positioning markers 90 adjacent the longitudinal centerline 44 of the plank 10 and a fourth pair a positioning markers 100 adjacent the longitudinal centerline of the plank 100, each of the positioning markers 92 and 94 of the third pair 90 and 102 and 104 fourth pair 100 aligned on opposite sides of the longitudinal centerline of the plank and also respectively aligned with a respective positioning marker of the third and fourth pair (90 aligned with 100 and 92 aligned with 102). These markers are referred to as yellow markers.

All of the positioning markers have receiving means within the positioning marker which extend into the lower surface of the plank. Alternatively, each positioning marker has attaching means.

Figure 2:
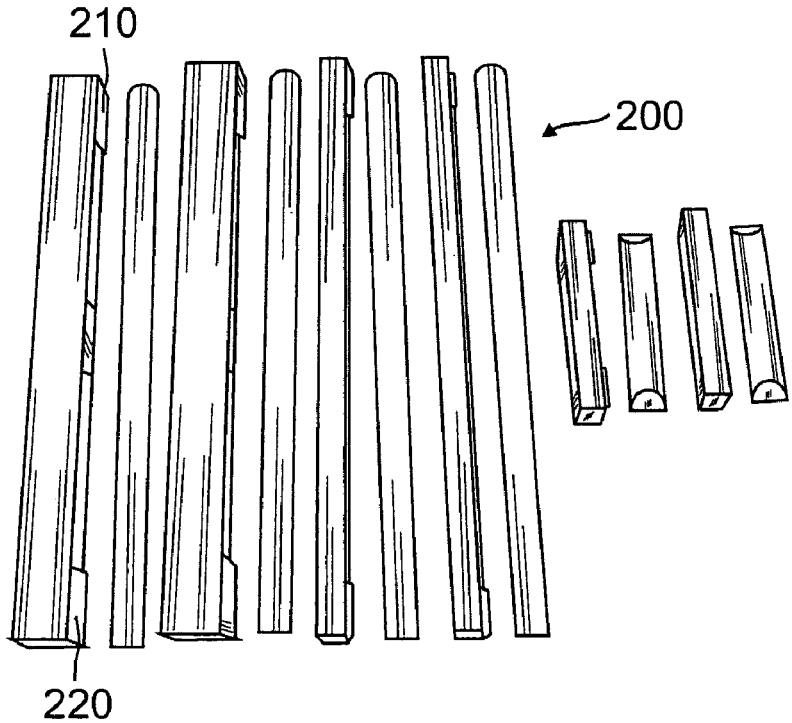
FIG. 2 is a front perspective view from above of 12 rubber/plastic height adjustable risers of the present invention.

Referring to FIG. 2, the apparatus also includes height adjustable risers 200 having mating means 210 and 220 which are received within receiving means of the positioning markers, each of the height adjustable risers insertable into two respective positioning markers to produce different orientations when the apparatus is in use.

Figure 12A:
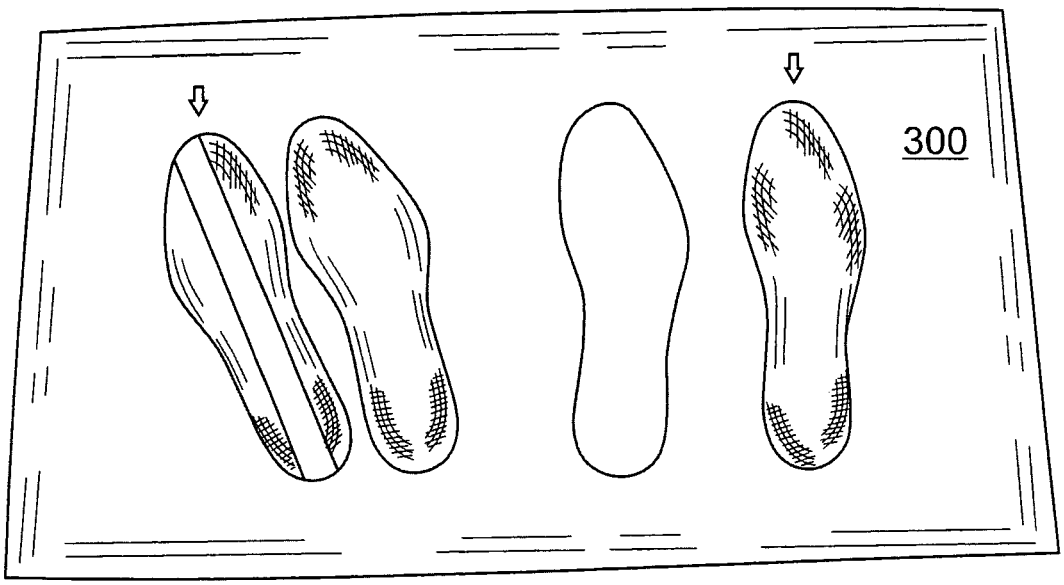
FIG. 12A is a top perspective view of a positioning template of the present invention for a full swing for a right handed golfer.
Figure 12B:
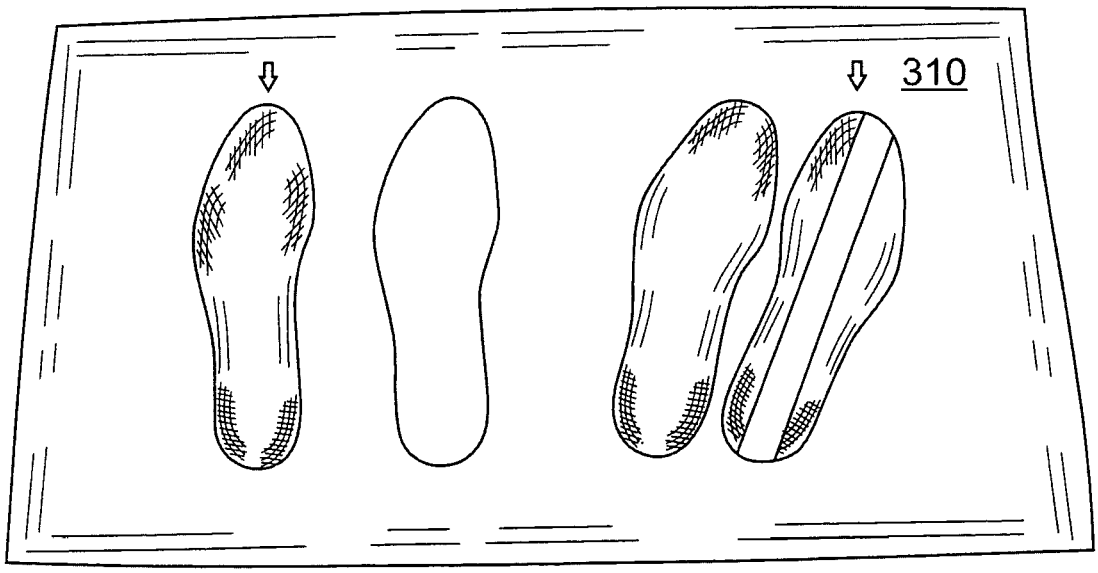
FIG. 12B is a top perspective view of a positioning template of the present invention for a full swing for a left handed golfer.
Figure 13A:
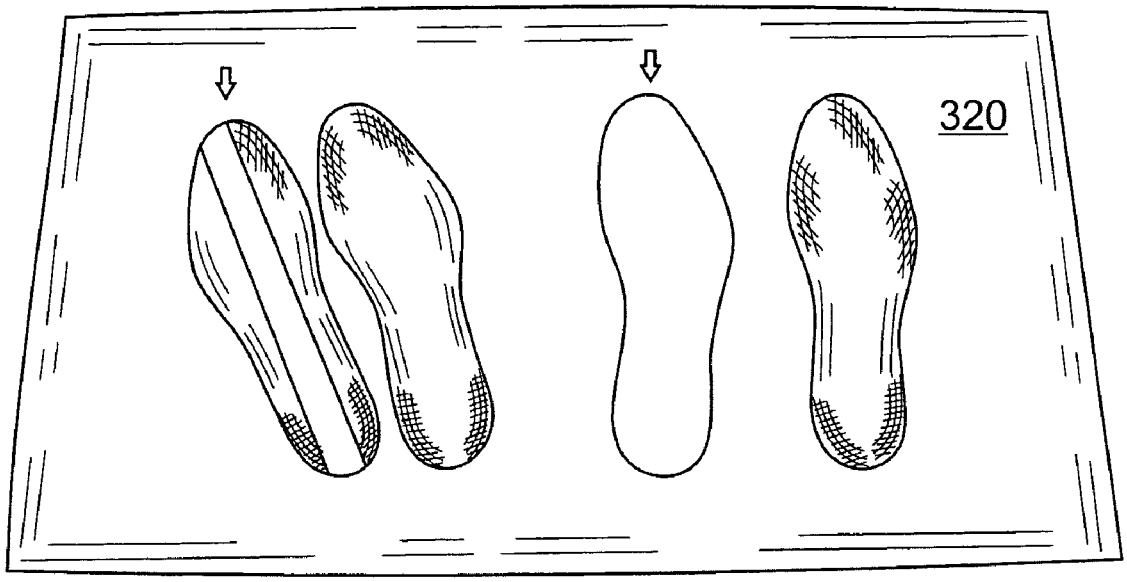
FIG. 13A is a top perspective view of a positioning template of the present invention for a pitch shot for a right handed golfer.
Figure 13B:
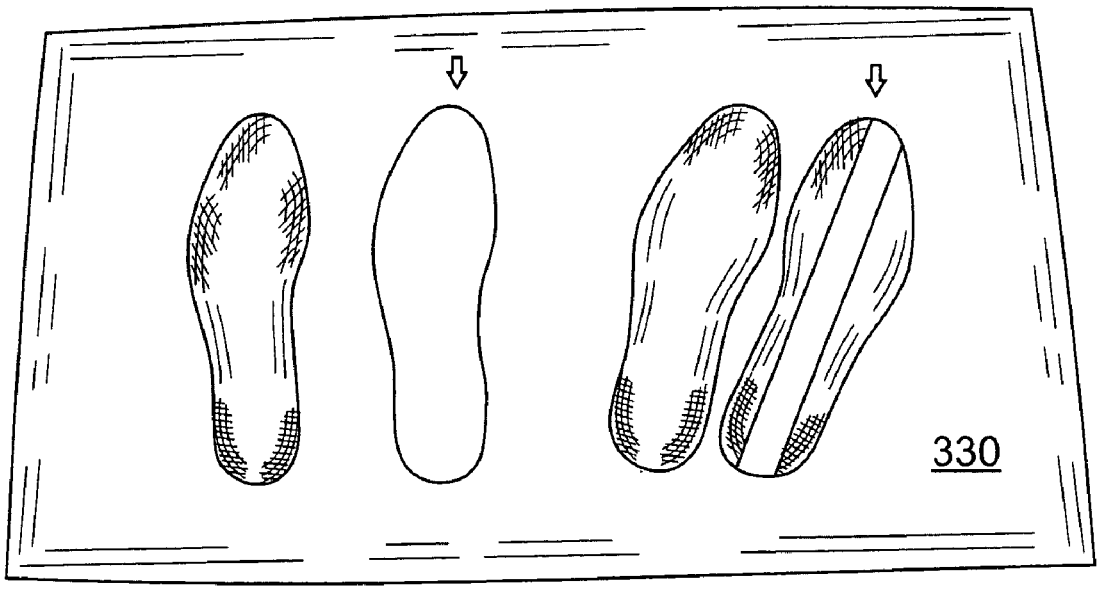
FIG. 13B is a top perspective view of a positioning template of the present invention for a pitch shot for a left handed golfer.
Figure 14A:
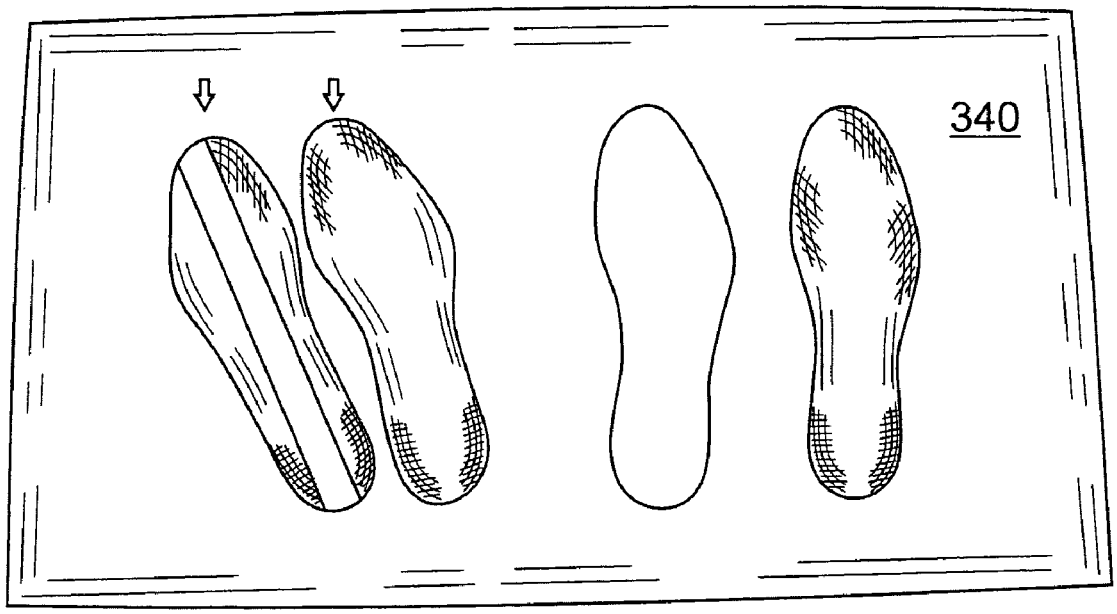
FIG. 14A is a top perspective view of a positioning template of the present invention for a chip shot for a right handed golfer.
Figure 14B:
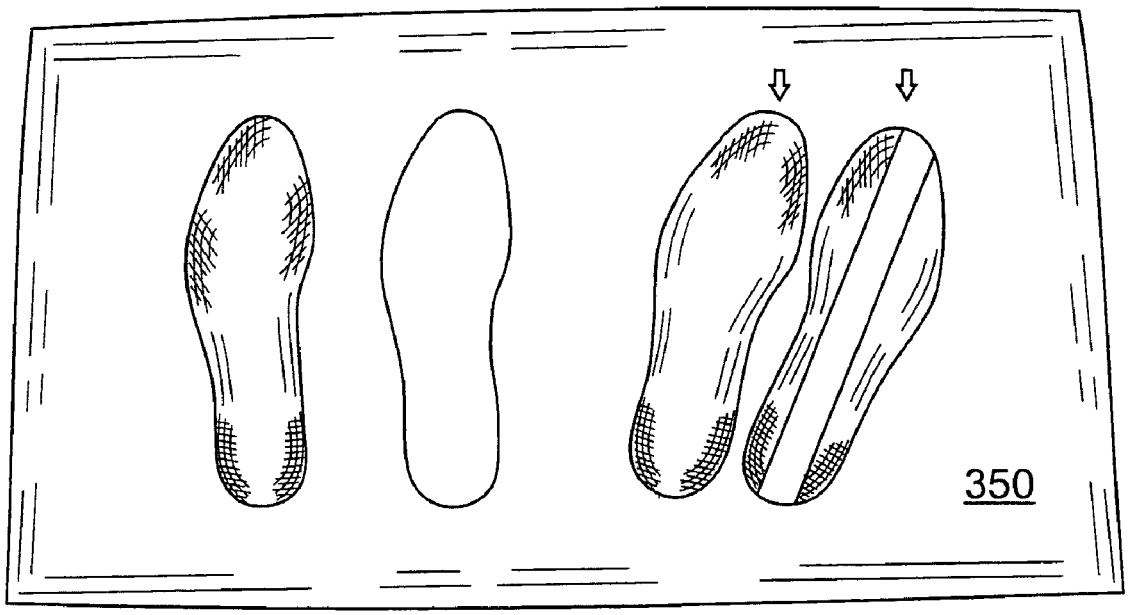
FIG. 14B is a top perspective view of a positioning template of the present invention for a chip shot for a left handed golfer.
Figure 15:
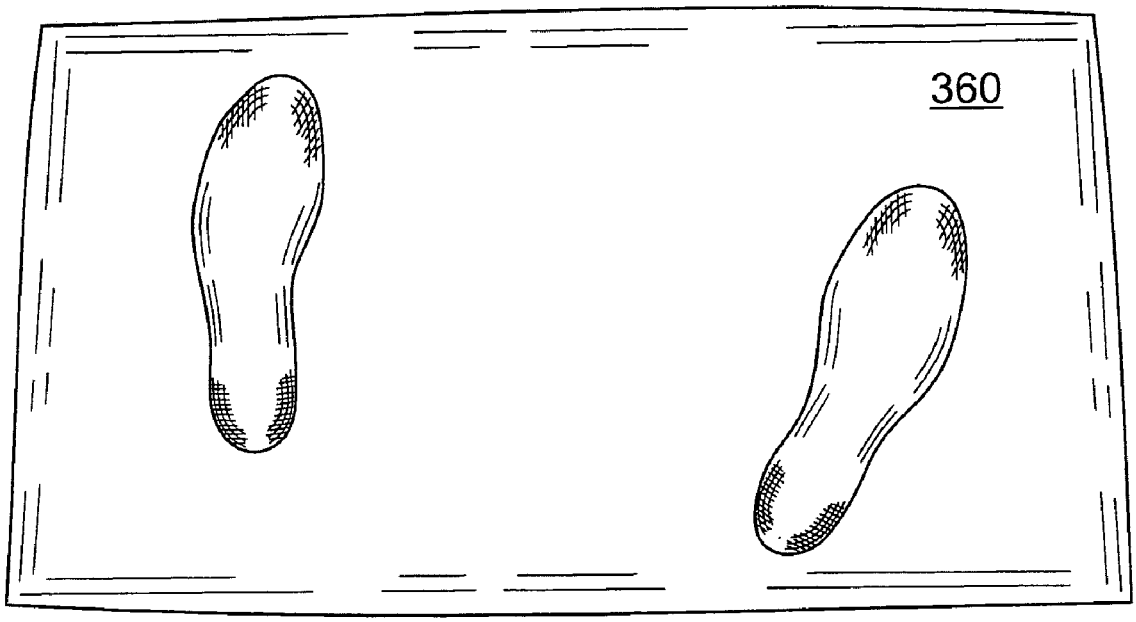
FIG. 15 is a top perspective view of a foot positioning template for a closed stance for a right handed golfer or an open stance for a left handed golfer.
Figure 16:
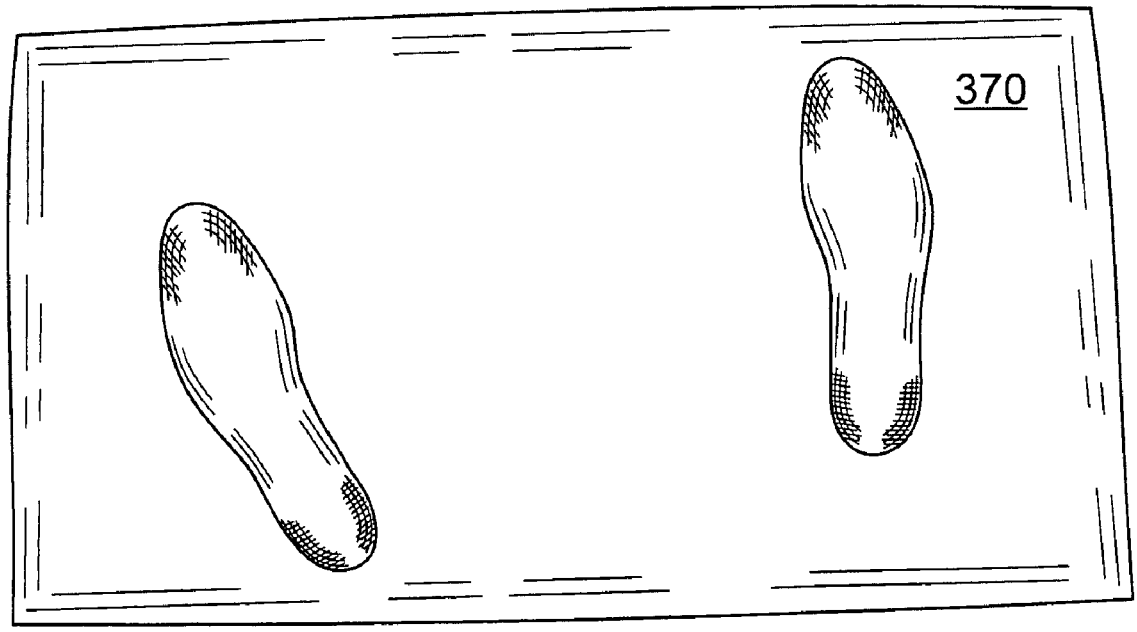
FIG. 16 is a top perspective view of a foot positioning template for an open stance for a right handed golfer or a closed stance for a left handed golfer.

The apparatus also includes a multiplicity of foot positioning templates with a given one template attachable to the upper surface of the plank for use at a given time. The multiplicity of foot positioning templates is selected from the group consisting of full swing right handed 300 as shown in FIG. 12A, full swing left handed 310 as shown in FIG. 12B, pitch shot right handed 320 as shown in FIG. 13A, pitch shot left handed 330 as shown in FIG. 13B, chip shot right handed 340 as shown in FIG. 14A, chip shot left handed 350 as shown in FIG. 14B, closed stance right handed and open shot left handed 360 as shown in FIG. 15, open stance right handed and closed stance left handed 370 as shown in FIG. 16. It will be appreciated that there are numerous other foot positioning templates that are within the spirit and scope of the present invention.

Figure 19:
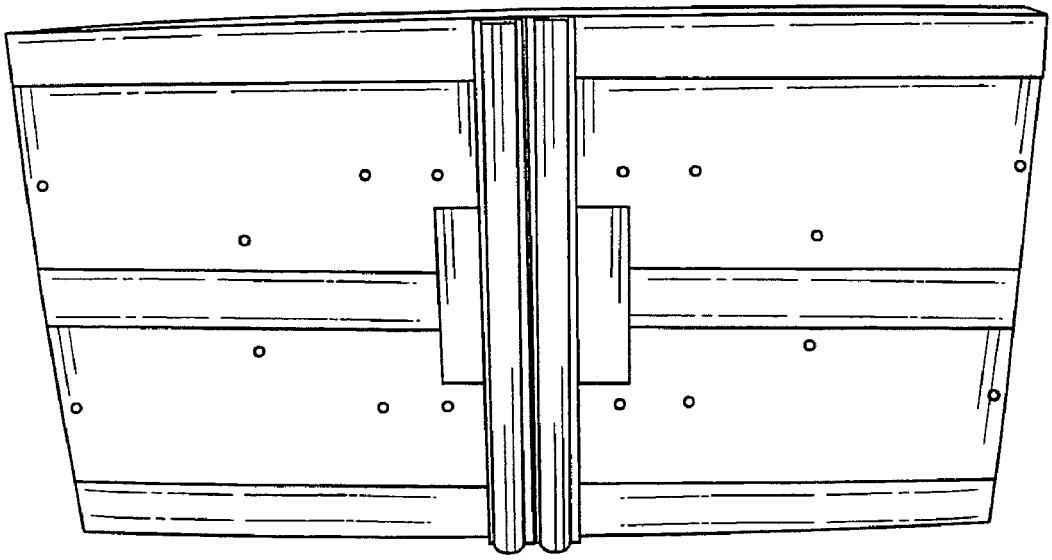
FIG. 19 is a bottom plan view of the present invention golf swing power shift board with two adjustable risers placed in the red positioning markers and placed close together which requires the golfer to have more balance so the board will tilt.
Figure 20:
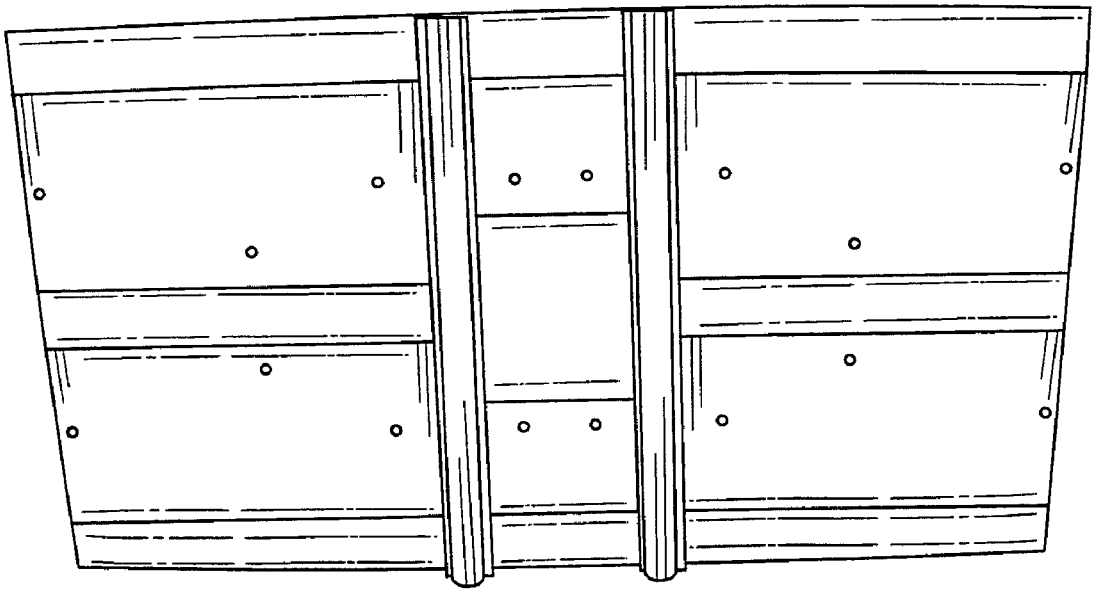
FIG. 20 is a bottom plan view of the present invention golf swing power shift board with two adjustable risers placed in the respective pair of two rows of positioning markers with the markers placed further apart than as illustrated in FIG. 19 which therefore requirse less balance than FIG. 19.

As will be described herein, in one variation two height adjustable risers 200 are used and respectively inserted over a pair of positioning markers (52 and 62, or 54 and 64, or 56 and 66, or 58 and 68 or 51 and 61 or 53 and 63) in the first row 50 and second row 60 so that the two height adjustable risers are parallel, spaced apart, and are parallel to the widthwise edges 26 and 28 of the plank 10. This is illustrated in FIGS. 17, 19 and 20.

Figure 21:
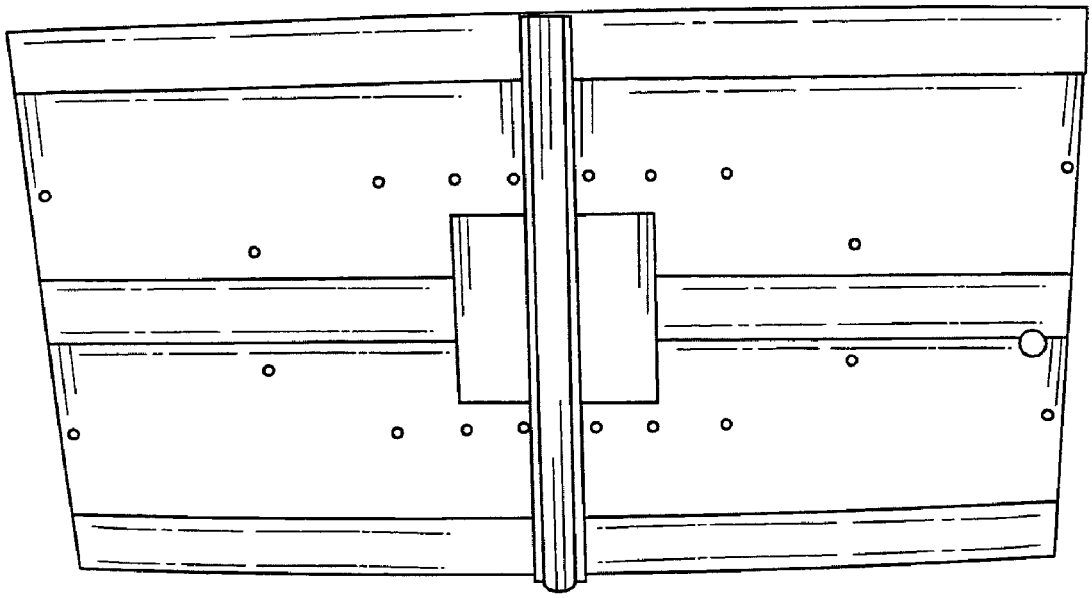
FIG. 21 is a bottom plan view of the present invention golf swing power shift board with a single height adjustable rise placed in a pair of positioning markers along the widthwise center line of the golf swing practice board which requires a golfer to have greater ability to balance than as required in FIG. 19 and FIG. 20.

As will be described herein, in another variation one height adjustable riser 200 is used and inserted over a pair of positioning markers (52 and 62, or 54 and 64, or 56 and 66, 22- or 58 and 68 or 51 and 61 or 53 and 63) in the first row 50 and second row 60 so that the height adjustable risers is parallel, spaced apart, and is parallel to the widthwise edges 26 and 28 of the plank 10. This is illustrated in FIGS. 21, 28, 30 and 31. The one height adjustable riser 200 can also be aligned with the widthwise centerline 42 of the plank 10 as also illustrated in FIG. 21.

As will be described herein, in another variation one height adjustable riser 200 is used and inserted over two positioning markers in the first pair 70 or 72 and the second pair 80 or 82 markers so that the height adjustable riser is parallel to the widthwise edges of the plank. This is respectively illustrated in FIGS. 28 and 30.

Figure 27:
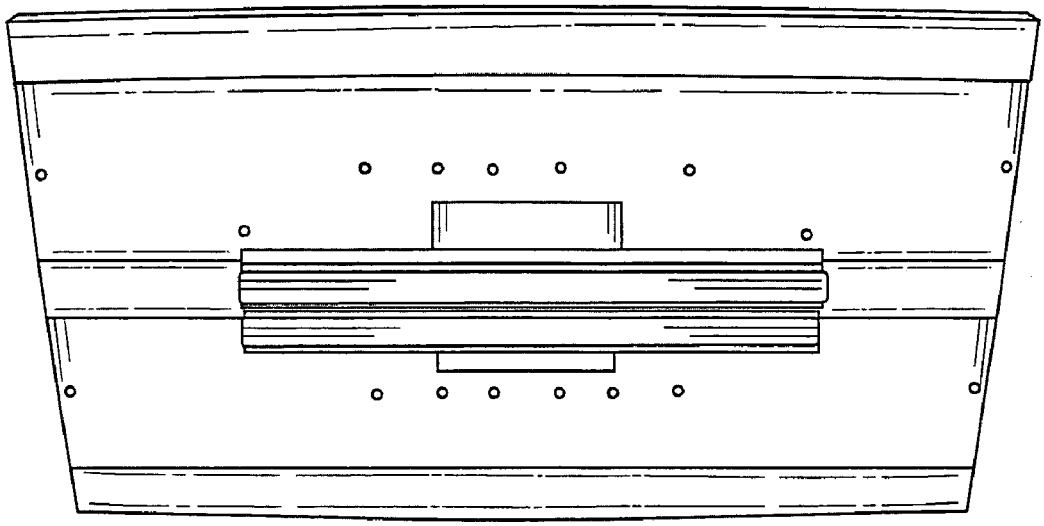
FIG. 27 is a bottom plan view of the present invention golf swing power shift board with two height adjustable risers placed within what is defined as a third and fourth pair of position markers (also called yellow positioning markers) with the height adjustable risers oriented in the longitudinal direction so that front and back balance is exercised.
Figure 28:
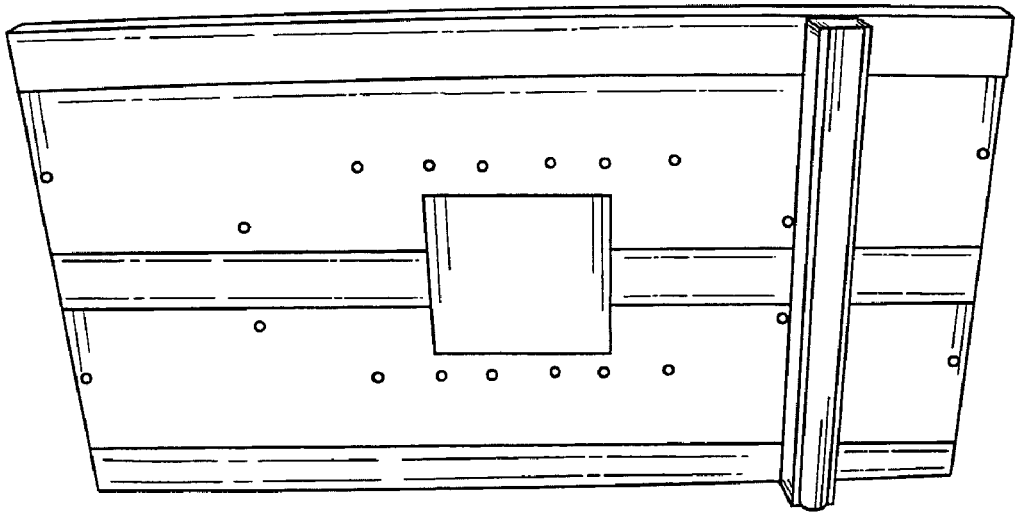
FIG. 28 is a bottom plan view of a golf swing power shift board with a single height adjustable riser placed within what is defined as a first and second pair of positioning markers as defined in the blue pair of positioning markers each respectively adjacent one widthwise edge which tilts the golfer's body onto the right side and is used to practice an uphill lie for a right handed golfer.
Figure 29:
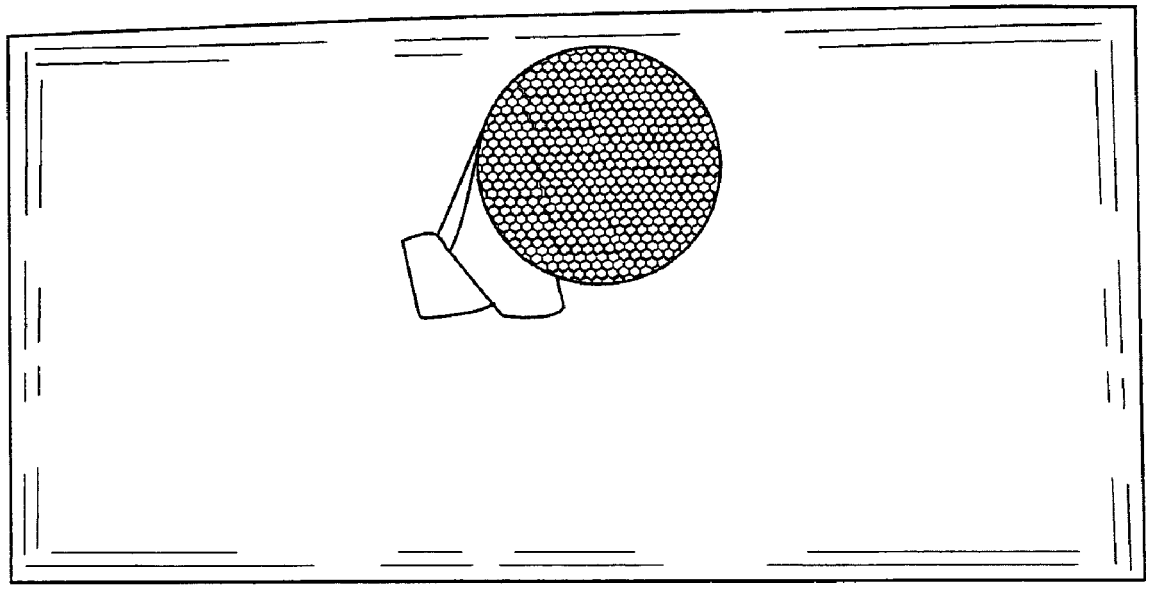
FIG. 29 is a perspective view of a placement of a piece of plastic tape on a practice pad to hold the golf ball.

As will be described herein, in another variation two height adjustable risers 200 are used and respectively inserted over a positioning marker 92 or 94 in the third pair of positioning markers 90 and over a positioning marker 102 or 104 in the fourth pair of positioning markers 100 so that the height adjustable risers are spaced apart and are parallel to the lengthwise sides 22 and 24 of the plank 10. This is illustrated in FIG. 27.

It will be understood that the positioning markers are location references and the weight adjustment risers have attaching means such as Velcro® or some other mechanical means to affix the height adjustable risers over the location of a positioning marker.

It will be appreciated that numerous other orientations are also within the spirit and scope of the present invention.

Training the Full Swing (Right to Left for Right-Handed Golfers):

Assuming that the practice area is level, and depending on the type of surface (rubber mat, artificial turf, grass, etc.), and/or how much weight shift the golfer wants to experience, the Two HAR should be placed "vertically" under the GSPSB between the red dots in the middle of the board (FIG. 17). The HAR will give the golfer immediate feedback when he/she steps on top of the GSPSB. The GSPSB will remain horizontal if the golfer is in balance during the club alignment and initial setup of the swing sequence. It will tilt to the left or right if the golfer is favoring one side over the other. As maintaining proper balance at the beginning of the golf swing is essential, the distance between the two HAR can vary (narrower or wider) depending on the height, weight and sensitivity of balance as it pertains to each golfer.

Figure 18:
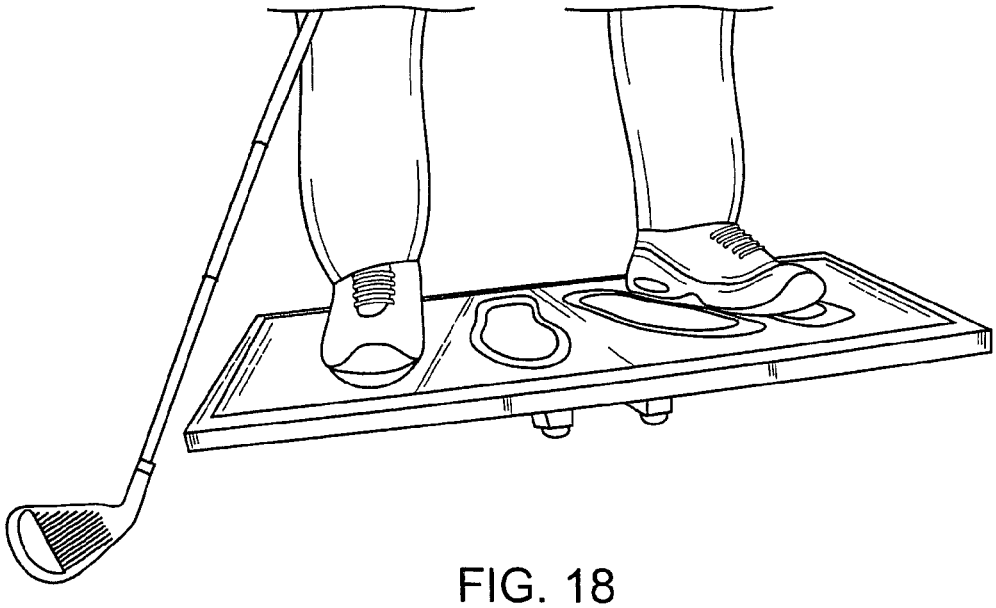
FIG. 18 is a perspective view of the present invention with two height adjustable risers placed in respective positioning markers in the first and second rows of the positioning markers and showing the tilting effect of the golf swing.

If the golfer is "right-handed," the GSPSB will tilt to the right side (FIG. 18) during the takeaway portion of the swing. Depending on the skill level of the golfer, or the level of weight shift the golfer wants to experience, the HAR can be moved closer together (FIG. 19) requiring more balance, or moved further apart (FIG. 20) requiring less balance. Advanced golfers can use a single HAR (FIG. 21) that requires an advanced level of body balance to practice full shots.

Figure 22:
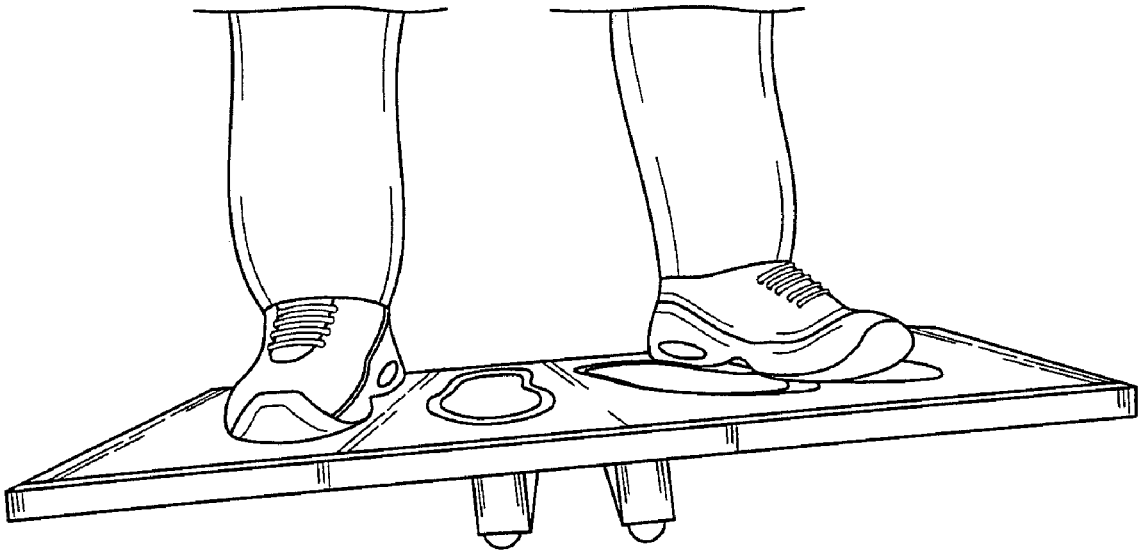
FIG. 22 illustrates a pivoting action using a pair of height adjustable risers on the golf swing power shift board comparable to the orientation shown in FIG. 17 showing the golfer's feet and tilt of the board during a take-away swing for a right handed golfer.
Figure 23:
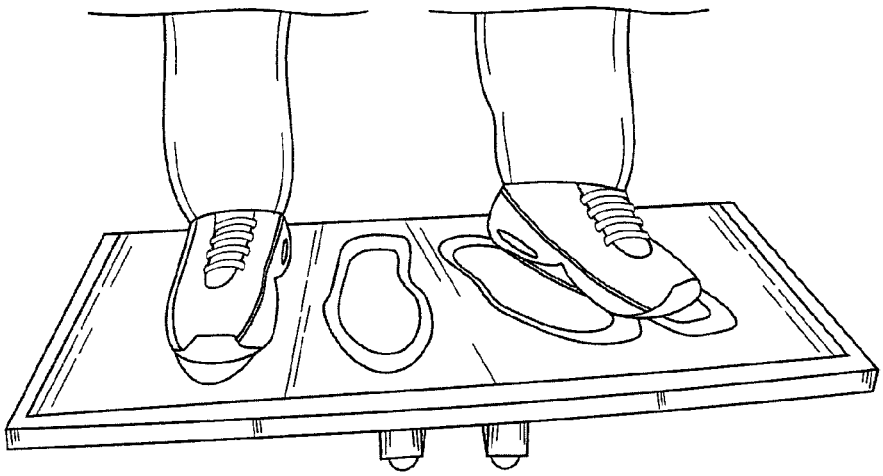
FIG. 23 illustrates a weight transfer motion using a pair of height adjustable risers on the golf swing power shift board comparable to the orientation shown in FIG. 17 showing the golfer's feet when the golfer initiates a downswing.

During the halfway point of the back swing, the right-handed golfer's weight will be transferred to his/her right side, and the GSPSB will be fully tilted to the right (producing a click as the board makes contact with the board surface) pivoting on the right HAR (FIG. 22). The weight transfer motion produced by the GSPSB mimics the weight shift outlined in FIG. 23. The left foot comes off the ground and the body coils to produce torque. The left heel can rise off the GSPSB to emphasize the weight shift and promote a complete shoulder turn of the full swing.

Figure 24:
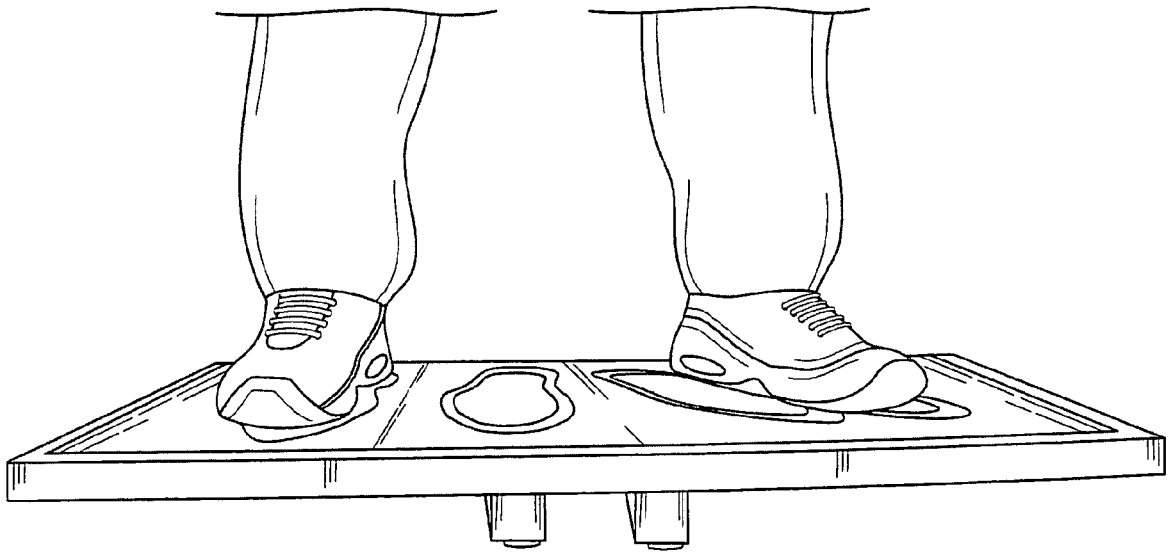
FIG. 24 illustrates a motion at the beginning of a downswing using a pair of height adjustable risers on the golf swing power shift board comparable to the orientation shown in FIG. 17.
Figure 25:
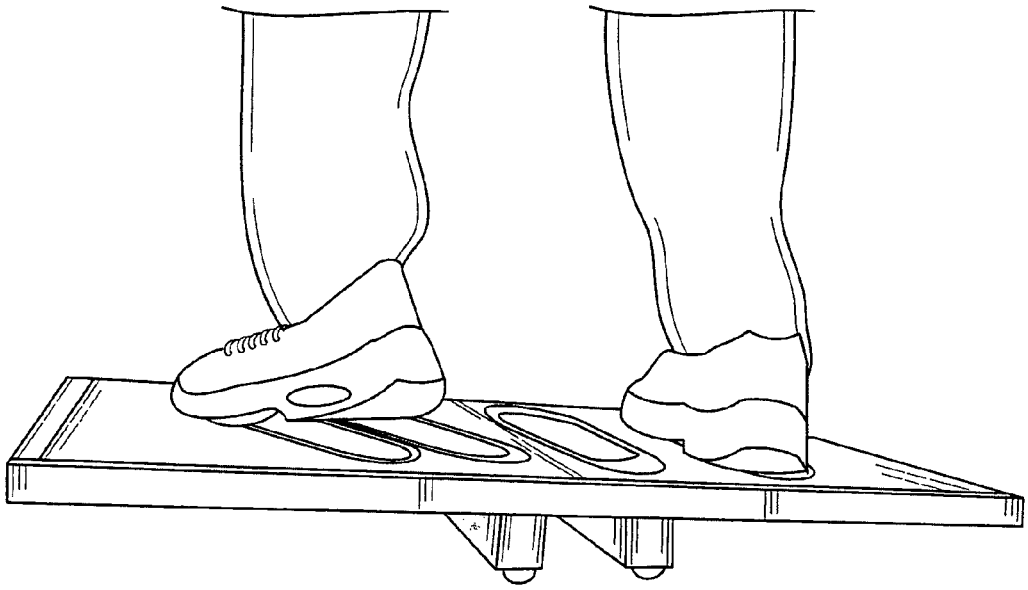
FIG. 25 illustrates a second click motion using a pair of height adjustable risers on the golf swing power shift board comparable to the orientation shown in FIG. 17.
Figure 26:
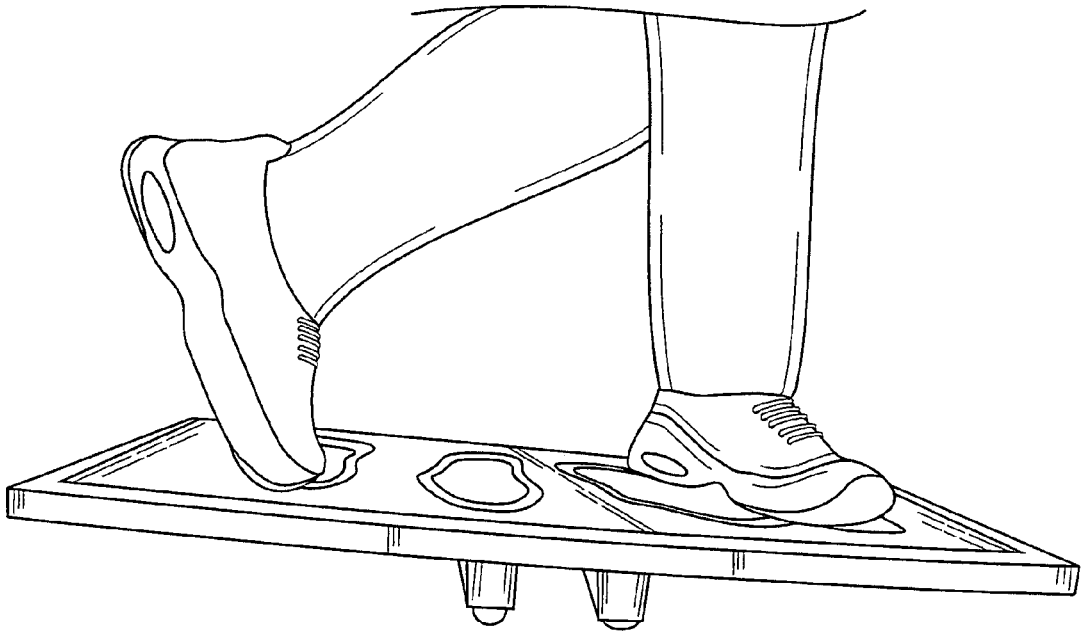
FIG. 26 illustrates a third click motion using a pair of height adjustable risers on the golf swing power shift board comparable to the orientation shown in FIG. 17.

Just before the arms reach their full back swing rotation, the left heel should come back down to the GSPSB (like a trigger) that begins the downswing (FIG. 24), thus creating the torque. As the left foot comes back down to the GSPSB, it promotes a weight shift ("power shift") that lifts the right side of the GSPSB off of the ground and sends it on its way to the HAR on the left side (producing a second click if the board is on a hard surface) (FIG. 25). The weight shift to the left will allow the golfer to rotate around his left leg. As a result of this weight shift, the shoulder will uncoil creating a "torque" that will propel the GSPSB onto the left side (producing a third "click" if the board is on a hard surface) (FIG. 26). The golfer will have completed a full swing as his/her hips, waist, chest and shoulders face the target with the weight over the left leg allowing the right foot to be positioned on the toe of the shoe.

Figure 30:
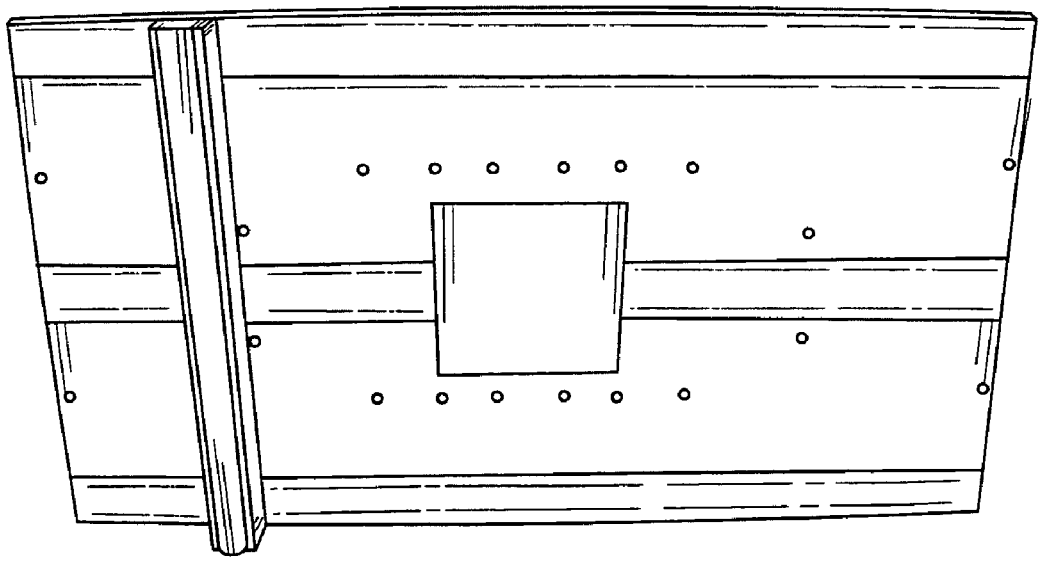
FIG. 30 is a bottom plan view of a golf swing power shift board with a single height adjustable riser placed within what is defined as the blue pair of positioning markers adjacent one widthwise edge opposite the view shown in FIG. 28 which tilts the golfer's body onto the left side and is used to practice a downhill lie for a right handed golfer.

Training Downhill Lie Shot (Front to Back for Right-Handed Golfers):

Assuming that the practice area is level, and depending on the type of surface (rubber mat, artificial turf, grass, etc.), and/or how much downhill gravity the golfer wants to experience, one section of HAR can be combined to reach a recommended of height between 1" to 3". it should be placed "vertically" under the GSPSB between the green dots on the left side of the board (FIG. 30). Note: In addition to combing HAR for more height, moving the HAR closer to the center of the GSPSB also increases the distance between the left side of the GSPSB and the level surface (for safety reasons do not increase the HAR above 3" or move the HAR past the Blue dots near the center of the GSPSB). Upon taking the stance on the GSPSB, the golfer will notice gravity pulling him/her downhill (to the right). Keep the weight over the left side and square the shoulders to the angle of the GSPSB. Upon execution of the back swing, note how easy it is to fall forward (to the left) as the club is taken back to a three quarter swing. To avoid falling forward, keep you weight over you right leg. To practice hitting balls, use the additional HAR provided to adjust any commercially sold golf swing practice mat to the proper angle matching it to the GSPSB.

Note: To keep the ball from rolling off of the practice board, fold and attach a piece of sturdy plastic tape to the practice pad as outlined in previous Figure.

Figure 31:
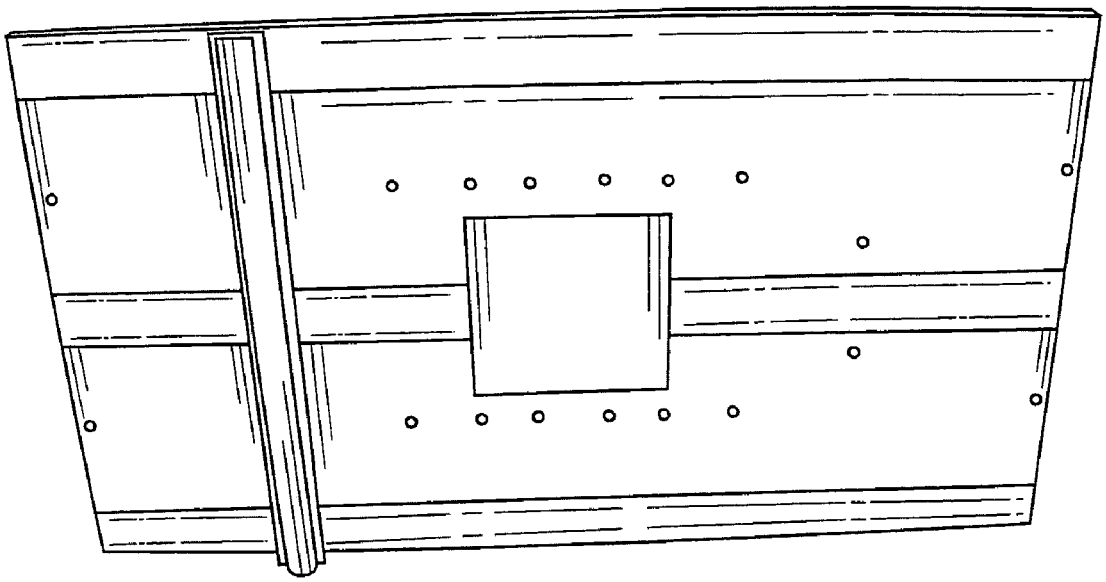
FIG. 31 is a bottom plan view of the present invention golf swing power shift board with a single height adjustment riser placed on a widthwise orientation in a pair of markers from the markers defined as the third and fourth pair of positioning markers comparable to FIG. 30 which tilts the golfer's body onto the left side and is used to practice a downhill lie for a right handed golfer but having a stronger tilt than the one illustrated in FIG. 30.

Training the Draw Shot (Right-Handed Golfers):

Insert the "Closed Stance" FPT into the GSPSB. Assuming that the practice area is level, and depending on the type of surface (rubber mat, artificial turf, grass, etc.), one section of HAR can be combined to reach a recommended of height between 1.5" to 3". Since this shot requires the golfer to keep his/her weight on the left hand side, the HAR should be placed "vertically" under the GSPSB over the yellow dots between the blue dots on the right side of the board (FIG. 31). In addition, use a stronger grip by rotating the left palm around the club in a clockwise direction, and close the club face by turning the face of the club in. Begin the back swing with a flatter trajectory. The inside-to-outside swing, closed stance and closed club face will create a right-to-left ball path.

Training the Fade Shot (Right-Handed Golfers): Insert the "Open Stance" FPT into the GSPSB. No HAR is required for this shot. Use a weaker grip by rotating the left palm around the club in a counter-clockwise direction, and open the club face by turning the face of the club out. Begin the back swing with an upright trajectory. The outside-to-inside swing, open stance and open club face will create a left-to-right ball path.

Figure 32:
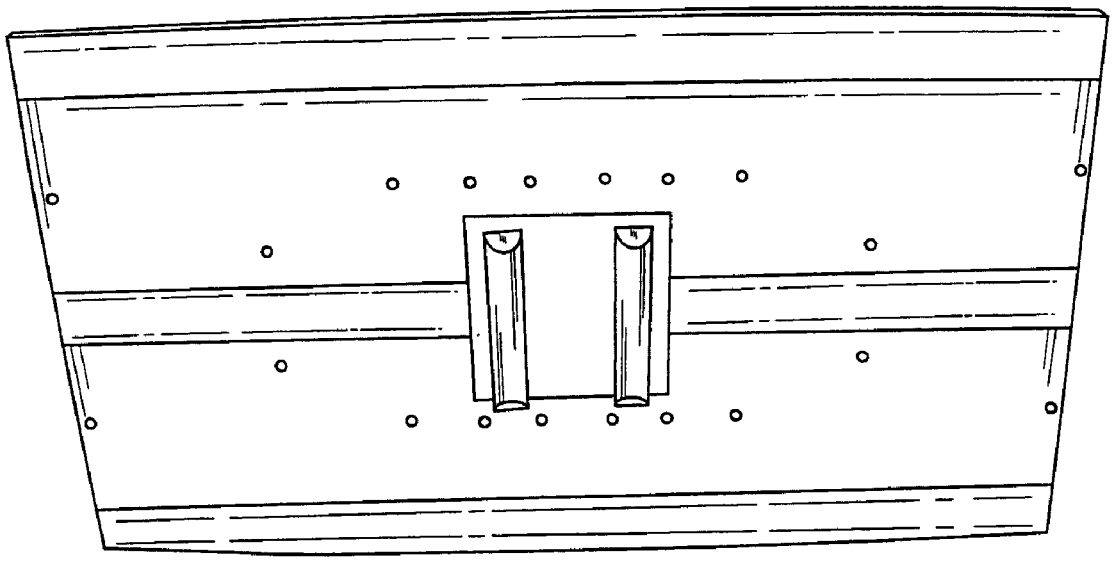
FIG. 32 is a bottom plan view showing the height adjustment risers in a smaller orientation placed within positioning markers on the golf swing power shift board which is an advanced system that permits tilting in both left and right and front and back directions to create exercise with a maximum balance.

Training the Advanced Full Swing (Right to Left and Front to Back for Right-Handed Golfers):

Assuming that the practice area is level, and depending on the type of surface (rubber mat, artificial turf, grass, etc.), and/or how much weight shift the golfer wants to experience, the two 6"×1.5"×0.75" (Rectangle) and two 6"×1"×0.5" (Half Round) should be combined and placed "vertically" under the GSPSB between the red dots in the middle of the board (FIG. 32). The HAR will give the golfer immediate feedback when he/she steps on top of the GSPSB. The GSPSB will remain horizontal if the golfer is in balance during the club alignment and initial setup of the swing sequence. However, it will tilt in any of the following combinations: left or right if the golfer is favoring one side over the other, and/or front or back if the golfer is favoring either direction. Follow the directions outlined in the "Training the Full Swing", but keep in mind that the golfer will need to keep the sequence of "Back, Shift, Swing" consistent, or the GSPSB will spin like a surfboard if the swing is out of sequence. This advanced practice will ensure that complete weight transfer occurs prior to shoulder rotation back and especially during the downswing into the ball. The golfer's body weight must completely transfer the GSPSB onto the left side BEFORE the downswing sequence begins, or the board will swing to the left.

Defined in detail, the present invention is an apparatus to improve a golf swing, comprising: (a) a generally rectangular shaped plank having an upper surface and a lower surface, a pair of oppositely disposed lengthwise sides and a pair of oppositely disposed widthwise edges, and a longitudinal centerline; (b) the lower surface of the generally rectangular shaped plank having a multiplicity of positioning markers including a first and second parallel row of positioning makers aligned along the lengthwise distance of the generally rectangular shaped plank, each positioning marker in a row spaced apart from an adjacent positioning marker by a given distance, the two rows of positioning markers respectively spaced away from a respective lengthwise side of the plank and also spaced apart from each other by a given distance, the lower surface also having a first pair of positioning markers adjacent one widthwise edge of the plank and a second pair of positioning markers adjacent an opposite widthwise edge of the plank, a respective positioning marker from the first pair aligned with a respective positioning marker from the second pair, the lower surface also having a third pair of positioning markers adjacent the longitudinal centerline of the plank and a fourth pair of positioning markers adjacent the longitudinal centerline of the plank, each of the positioning markers of the third and fourth pair aligned on opposite sides of the longitudinal centerline of the plank and also respectively aligned with a respective positioning marker of the third and fourth pair, all of the positioning markers acting as position reference locators on the plank; (c) height adjustable risers having mating means which are attached to the plank at the location of the positioning markers, each of the height adjustable risers affixed over at least two respective positioning markers to produce different orientations when the apparatus is in use; and (d) a multiplicity of foot positioning templates with a given one template attachable to the upper surface of the plank for use at a given time, the multiplicity of foot positioning templates selected from the group consisting of full swing right handed, full swing left handed, pitch shot right handed, pitch shot left handed, chip shot right handed, chip shot left handed, closed stance right handed and open shot left handed, open stance right handed and closed stance left handed.

Defined broadly, the present invention is an apparatus to improve a golf swing, comprising: (a) a plank having an upper surface and a lower surface, a pair of oppositely disposed lengthwise sides and a pair of oppositely disposed widthwise edges, a longitudinal centerline and a widthwise centerline; (b) the lower surface of the generally rectangular shaped plank having a multiplicity of positioning markers aligned in pairs and oriented to be on opposite sides of the longitudinal centerline of the plank or on opposite sides of the width centerline of the plank, each positioning marker acting as a reference locator on the plank; (c) height adjustable risers having mating means by which they are attached to the plank at a location of the positioning markers, each of the height adjustable risers attachable over two respective positioning markers to produce different orientations when the apparatus is in use; and (d) a given one of a multiplicity of foot positioning templates attachable to the upper surface of the plank for use at a given time.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to improve a golf swing, comprising:

a. a generally rectangular shaped plank having an upper surface and a lower surface, a pair of oppositely disposed lengthwise sides and a pair of oppositely disposed widthwise edges, and a longitudinal centerline;

b. the lower surface of the generally rectangular shaped plank having a multiplicity of positioning markers including a first and second parallel row of positioning makers aligned along the lengthwise distance of the generally rectangular shaped plank, each positioning marker in a row spaced apart from an adjacent positioning marker by a given distance, the two rows of positioning markers respectively spaced away from a respective lengthwise side of the plank and also spaced apart from each other by a given distance, the lower surface also having a first pair of positioning markers adjacent one widthwise edge of the plank and a second pair of positioning markers adjacent an opposite widthwise edge of the plank, a respective positioning marker from the first pair aligned with a respective positioning marker from the second pair, the lower surface also having a third pair of positioning markers adjacent the longitudinal centerline of the plank and a fourth pair of positioning markers adjacent the longitudinal centerline of the plank, each of the positioning markers of the third and fourth pair aligned on opposite sides of the longitudinal centerline of the plank and also respectively aligned with a respective positioning marker of the third and fourth pair, all of the positioning markers acting as position reference locators on the plank;

c. height adjustable risers having mating means which are attached to the plank at the location of the positioning markers, each of the height adjustable risers affixed over at least two respective positioning markers to produce different orientations when the apparatus is in use;

d. a multiplicity of foot positioning templates with a given one template attachable to the upper surface of the plank for use at a given time, the multiplicity of foot positioning templates selected from the group consisting of full swing right handed, full swing left handed, pitch shot right handed, pitch shot left handed, chip shot right handed, chip shot left handed, closed stance right handed and open shot left handed, open stance right handed and closed stance left handed; and e. the positioning of the height adjustment risers in particular positioning markers combined with the use of selected foot positioning templates determining the type of golf swing being simulated, the nature of the height adjustment risers enabling the apparatus to be in a stable condition regardless of which positioning markers the height adjustment risers are placed into.

2. The apparatus in accordance with claim 1 wherein two height adjustable risers are used and respectively affixed over a pair of positioning markers in the first and second row so that the two height adjustable risers are parallel, spaced apart, and are parallel to the widthwise edges of the plank.

3. The apparatus in accordance with claim 1 wherein one height adjustable riser is used and affixed over a positioning marker in the first and second row so that the height adjustable riser is parallel to the widthwise edges of the plank.

4. The apparatus in accordance with claim 3 wherein the plank has a widthwise centerline and the height adjustable riser is aligned with the widthwise centerline of the plank.

5. The apparatus in accordance with claim 1 wherein one height adjustable riser is used and affixed over a positioning marker in the first and second pair of positioning markers so that the height adjustable riser is parallel to the widthwise edges of the plank.

6. The apparatus in accordance with claim 1 wherein two height adjustable riser are used and respectively affixed over a positioning marker in the third and fourth pair of positioning markers so that the height adjustable risers are spaced apart and are parallel to the lengthwise sides edges of the plank.

7. The apparatus in accordance with claim 1 further comprising height adjustable risers to be used with golf ball mat.

8. The apparatus in accordance with claim 1 wherein the plank is made of material selected form the group consisting of wood, aluminum, and hard plastic.

9. An apparatus to improve a golf swing, comprising:

a. a plank having an upper surface and a lower surface, a pair of oppositely disposed lengthwise sides and a pair of oppositely disposed widthwise edges, a longitudinal centerline and a widthwise centerline;

b. the lower surface of the generally rectangular shaped plank having a multiplicity of positioning markers aligned in pairs and oriented to be on opposite sides of the longitudinal centerline of the plank or on opposite sides of the width centerline of the plank, each positioning marker acting as a reference locator on the plank;

c. height adjustable risers having mating means by which they are attached to the plank at a location of the positioning markers, each of the height adjustable risers attachable over two respective positioning markers to produce different orientations when the apparatus is in use; and d. a given one of a multiplicity of foot positioning templates attachable to the upper surface of the plank for use at a given time; and e. the positioning of the height adjustment risers in particular positioning markers combined with the use of selected foot positioning templates determining the type of golf swing being simulated, the nature of the height adjustment risers enabling the apparatus to be in a stable condition regardless of which positioning markers the height adjustment risers are placed into.

10. The apparatus in accordance with claim 9 wherein the multiplicity of foot positioning templates is selected from the group consisting of full swing right handed, full swing left handed, pitch shot right handed, pitch shot left handed, chip shot right handed, chip shot left handed, closed stance right handed and open shot left handed, open stance right handed and closed stance left handed.

11. The apparatus in accordance with claim 9 further comprising height adjustable risers to be used with golf ball mat.

12. The apparatus in accordance with claim 9 wherein the plank is made of material selected form the group consisting of wood, aluminum, and hard plastic.

13. The apparatus in accordance with claim 9, wherein the positioning markers include a first and second parallel row of positioning makers aligned along the lengthwise distance of the generally rectangular shaped plank, each positioning marker in a row spaced apart from an adjacent positioning marker by a given distance, the two rows of positioning markers respectively spaced away from a respective lengthwise side of the plank and also spaced apart from each other by a given distance, the lower surface also having a first pair of positioning markers adjacent one widthwise edge of the plank and a second pair of positioning markers adjacent an opposite widthwise edge of the plank, a respective positioning marker from the first pair aligned with a respective positioning marker from the second pair, the lower surface also having a third pair of positioning markers adjacent the longitudinal centerline of the plank and fourth pair of positioning markers adjacent the longitudinal centerline of the plank, each of the positioning markers of the third and fourth pair aligned on opposite sides of the longitudinal centerline of the plank and also respectively aligned with a respective positioning marker of the third and fourth pair, an opposite widthwise edge of the plank, a respective positioning marker from the first pair aligned with a respective positioning marker from the second pair.

14. The apparatus in accordance with claim 13 wherein the plank has a widthwise centerline and the height adjustable riser is aligned with the widthwise centerline of the plank.

15. The apparatus in accordance with claim 13 wherein one height adjustable riser is used and affixed over a positioning marker in the first and second pair of positioning markers so that the height adjustable riser is parallel to the widthwise edges of the plank.

16. The apparatus in accordance with claim 13 wherein two height adjustable riser are used and respectively affixed over a positioning marker in the third and fourth pair of positioning markers so that the height adjustable risers are spaced apart and are parallel to the lengthwise sides edges of the plank.

17. The apparatus in accordance with claim 13 wherein two height adjustable risers are used and respectively affixed over a pair of positioning markers in the first and second row so that the two height adjustable risers are parallel, spaced apart, and are parallel to the widthwise edges of the plank.

18. The apparatus in accordance with claim 13 wherein one height adjustable riser is used and affixed over a positioning marker in the first and second row so that the height adjustable riser is parallel to the widthwise edges of the plank.

* * * * *